US009203168B2

(12) United States Patent
Guering

(10) Patent No.: US 9,203,168 B2
(45) Date of Patent: Dec. 1, 2015

(54) POWER BREAKER STRIP FOR THE FIXED-PITCH CONNECTION OF SEVERAL ELECTRICAL CABLES LINES

(71) Applicant: Airbus Operations (SAS), Toulouse (FR)

(72) Inventor: Bernard Guering, Montrabe (FR)

(73) Assignee: Airbus Operations (SAS), Toulouse (FR)

( * ) Notice: Subject to any disclaimer, the term of this patent is extended or adjusted under 35 U.S.C. 154(b) by 0 days.

(21) Appl. No.: 14/332,636

(22) Filed: Jul. 16, 2014

(65) Prior Publication Data

US 2015/0024638 A1 Jan. 22, 2015

(30) Foreign Application Priority Data

Jul. 18, 2013 (FR) ..... 13 57075

(51) Int. Cl.

| | |
|---|---|
| ***H01R 9/26*** | (2006.01) |
| ***H01R 9/24*** | (2006.01) |
| ***H01R 9/22*** | (2006.01) |
| *H01R 11/09* | (2006.01) |

(52) U.S. Cl.

CPC ..... *H01R 9/2408* (2013.01); *H01R 9/223* (2013.01); *H01R 9/26* (2013.01); *H01R 11/09* (2013.01); *H01R 2201/26* (2013.01)

(58) Field of Classification Search

CPC ..... H01R 9/26; H01R 9/2408; H01R 9/2458; H01R 9/2675; H01R 13/506

USPC ..... 439/721, 716, 717, 709, 723

See application file for complete search history.

(56) References Cited

U.S. PATENT DOCUMENTS

| | | | | |
|---|---|---|---|---|
| 3,753,216 | A | 8/1973 | Johnson et al. | |
| 5,326,285 | A | 7/1994 | Maros | |
| 6,746,279 | B1 * | 6/2004 | Lopez | 439/620.01 |
| 8,465,331 | B2 * | 6/2013 | Shimowake et al. | 439/709 |

FOREIGN PATENT DOCUMENTS

| | | | | |
|---|---|---|---|---|
| AT | 8262 U1 | | 4/2006 | |
| FR | 1141471 | | 9/1957 | |
| GB | 907204 | | 10/1962 | |
| JP | 2000287337 A | * | 10/2000 | H02G 3/16 |

OTHER PUBLICATIONS

French Search Report, Jan. 29, 2014.

* cited by examiner

*Primary Examiner* — James Harvey
*Assistant Examiner* — Matthew T Dzierzynski
(74) *Attorney, Agent, or Firm* — Greer Burns & Crain Ltd.

(57) ABSTRACT

A power breaker strip comprising a strip support and a plurality of interphase spacer elements, and a plurality of interline spacer elements, assembled with the plurality of interphase spacer elements such that each interline spacer element extends at least partly between two consecutive interphase spacer elements. The interphase spacer elements and the interline spacer elements together delimit a plurality of per pitch zones of the strip in which connection terminals of several lines of electrical cables can be inserted.

13 Claims, 4 Drawing Sheets

STATE OF THE ART

STATE OF THE ART

STATE OF THE ART

POWER BREAKER STRIP FOR THE FIXED-PITCH CONNECTION OF SEVERAL ELECTRICAL CABLES LINES

CROSS-REFERENCES TO RELATED APPLICATIONS

This application claims the benefit of the French patent application No. 13 57075 filed on Jul. 18, 2013, the entire disclosures of which are incorporated herein by way of reference.

BACKGROUND OF THE INVENTION

This invention relates to the field of systems used in electrical installations to connect electrical cables, and particularly power cables, to each other. In particular, it relates to the field of power breaker strip with terminals.

The invention thus specifically discloses a power breaker strip for fixed-pitch connection of several electrical cable lines, and an electrical installation containing it and a method of assembling such a power breaker strip.

It is applicable mainly in the field of aeronautics, particularly for electrical equipment installed onboard an aircraft.

The use of power breaker strip with terminals (hereinafter called "breaker strip" for simplification) to connect electrical power cables in an electrical installation, and particularly an electrical installation onboard an aircraft may be necessary for various reasons and more particularly for industrial and/or technical reasons.

Industrially, the use of a breaker strip is used mainly to connect assemblies on which electrical systems are pre-installed. Furthermore, for the special case of a breaker strip of the type described below with reference to FIG. 1, the breaker strip may also be used to connect power distribution cables output from an electrical core to the corresponding power cables located on the general circuit of an aircraft.

Technically, the use of a breaker strip can modify the nature and/or the size of power cables. The rules and conditions applicable outside and inside electrical boxes are different, such that cables optimised for their context have to be used. For example, since electrical cores have internal conditions with higher temperatures, lower bending radii and shorter circuit lengths, the choice of copper electrical cables is preferred. On the other hand, in the lack of such external conditions, aluminium (lighter weight) electrical cables can be used.

Several examples of breaker strips for the connection of power cables are already known in the prior art. FIGS. 1 to 3 show an example embodiment of such a breaker strip.

FIG. 1 shows a perspective view of a breaker strip 1 used for the connection of power cables 2. The breaker strip 1 comprises a metal support 3 on which a set of terminals 14 is fixed arranged at a regular pitch along the support 3, each terminal 14 being electrically insulated from adjacent terminals by spacers 4 usually made from polytetrafluoroethylene (PTFE) and by resin cores. FIG. 3 shows details of the connection principle for two power cables 2 at a terminal 14. A metal insert 11 passes through the lugs 10 of the two power cables 2 so that they can be attached by screwing into a resin core 12 located on the metal support 3.

Nevertheless, the use of such a breaker strip 1 is not entirely satisfactory. First, it has a low breaking density, in other words for example, breaking one line among a fairly small number of power cables requires a large amount of space. Each pitch at which there is a terminal 14 between two spacers 4 covers a line of power cables 2, such that the width of the breaker strip 1 increases when the number of power cable lines 2 increases. Furthermore, as can be seen in FIG. 2, the breaker strip 2 according to the prior art has to be adapted on an intermediate structural support 8 before being fixed to the primary structure 9 of the aircraft. In other words, it is not sufficient in itself. Furthermore, such a breaker strip 1 usually has a high total mass due to the use of metal in the support 3 and the inserts 11 integrated into solid resin cores 12. Furthermore, this type of breaker strip 1 cannot change, and the pre-installation of all its elements makes it necessary to keep a maximum mass in flight even if the breaker strip 1 is only partially used. Still furthermore, when considering the environment of an aircraft in which these breaker strips 1 can be used, the width imposed by them (in other words, a line of cables with fixed-pitch breakers) makes it impossible to route and break power cable lines 2 in the same direction.

SUMMARY OF THE INVENTION

There is a need to design a new type of power breaker strip, particularly to simplify electrical installation equipment operations and to make them more efficient.

A purpose of the invention is to at least partially overcome the needs mentioned above and the disadvantages with embodiments according to the prior art.

According to one of its aspects, the invention thus relates to a power breaker strip comprising:

- a strip support,
- a plurality of interphase, electrically insulating spacer elements distributed along the strip support with a space between two consecutive interphase spacer elements defining a pitch of the power breaker strip, characterised in that it also comprises:

- a plurality of electrically insulating interline spacer elements, assembled with the plurality of interphase spacer elements such that each interline spacer element extends at least partly between two consecutive interphase spacer elements, the interphase spacer elements and the interline spacer elements delimiting a plurality of pitch zones between them in which connection terminals for several electrical cable lines, and particularly power cable lines, can be placed.

With the invention, it might be possible to have a breaker strip that has a high breaking density because several electrical cable lines can be broken on each pitch of the strip, and also modifiable because it would make it easier and faster to add connected cables, and structurally integrated because the breaker strip can be fixed to a primary structure of an aircraft without requiring the use of an intermediate structural support. Furthermore, the possibility of connecting several electrical cable lines per pitch on the strip can considerably reduce the size of the strip and electrical cables in an electrical installation. The invention can also create a significant saving of cost and mass compared with solutions according to the prior art.

The breaker strip according to the invention may also comprise one or several of the following characteristics taken in isolation or in any technically possible combination.

The breaker strip may include any electrical connection element necessary for the connection of electrical cables, for example such as screws and washers and particularly electrical connection terminals, hence the term "power breaker strip with terminals".

Each interphase spacer element may be provided with an opening through which the strip support can pass.

Interphase spacer elements may have several shapes, particularly rectangular or preferably square.

The opening in each interphase spacer element may be a central opening in this element, particularly in a rectangular or square shape.

Advantageously, interphase spacer elements may be used to define a pitch of the breaker strip and also to maintain the pitch.

The assembly of interphase spacer elements with interline spacer elements can define an insertion corridor for the strip support containing all openings in interphase spacer elements.

Interline spacer elements and/or interphase spacer elements may comprise notches into which interphase spacer elements and/or interline spacer elements can be inserted.

Each interline spacer element may comprise a plurality of notches for the insertion of interphase spacer elements, these notches being uniformly distributed along the interline spacer element.

Each interphase spacer element may comprise a plurality of notches for the insertion of interline spacer elements, these notches being distributed particularly around the periphery of the central opening of the interphase spacer element, particularly at each corner of the central opening.

Interline spacer elements may be in several shapes, particularly longitudinal, and particularly approximately rectangular.

An interline spacer element can be assembled with an interphase spacer element by inserting the interline spacer element through the opening in the interphase spacer element, and then fixing it to the interphase spacer element by inserting the interphase spacer element into a notch in the interline spacer element.

The strip support may comprise at least four external faces in contact with the interphase spacer elements, the strip support particularly being in a shape of a tube.

The strip support may in particular be in the shape of a hollow tube. The strip support may thus be longitudinal in shape.

The strip support may have a rectangular-shaped and preferably square-shaped section. In particular, the shape of the section of the strip support may be identical to the shape of the openings in the interphase spacer elements.

The breaker strip may comprise at least four interline spacer elements, in particular each interline spacer element being located approximately at an edge of the strip support.

In particular, the interline spacer elements may be assembled to the interphase spacer elements such that each interline spacer element covers an edge of the strip support.

Each interphase spacer element may be assembled to said at least four interline spacer elements.

In particular, said at least four interline spacer elements may be assembled to a given interphase spacer element, comprising a square or rectangular opening at the four corners of the opening.

The interphase spacer elements and the interline spacer elements may delimit at least three pitch zones between them in which the connection terminals of at least three lines of electrical cables can fit.

A first pitch zone may contain a connection terminal of a first line of electrical cables fixed on a first face of the strip support. A third pitch zone may comprise a connection terminal of a third line of electrical cables, fixed on a second face of the strip support opposite the first face. A second pitch zone may comprise two connection terminals of a second line of electrical cables fixed onto the third and fourth opposite faces respectively of the strip support.

The strip support and/or the plurality of interphase spacer elements and/or the plurality of interline spacer elements may be made of a composite material.

In particular, composite materials comprising glass fibres and resin may be used.

Another purpose of the invention according to another of its aspects is an electrical installation and particularly an electrical installation in an aircraft, characterised in that it comprises a power breaker strip as defined above, for the connection of electrical cables, particularly power cables, to each other.

At least three lines of electrical cables may be electrically connected in each pitch of the power breaker strip.

Another purpose of the invention according to another of its aspects is a method of assembling a power breaker strip like that defined above, characterised in that it comprises the following steps in sequence:

- assembly of interphase spacer elements with interline spacer elements, particularly by the insertion of notches in the interphase spacer elements in notches in the interline spacer elements,
- possibly, attachment of interphase spacer elements to interline spacer elements, particularly by gluing,
- insertion of the strip support inside the assembly composed of the assembly of interphase spacer elements and the interline spacer elements through the openings in the interphase spacer elements.

The electrical installation and the method according to the invention may include any one of the characteristics mentioned above, taken in isolation or in any technically possible combination with other characteristics.

BRIEF DESCRIPTION OF THE DRAWINGS

The invention will be better understood after reading the following detailed description of a non-limitative example embodiment of the invention, and by the examination of the partial and diagrammatic figures and the appended drawing in which.

In all these figures, identical references may refer to identical or similar elements.

Furthermore, the different parts in the figures are not necessarily at the same scale, to make the figures more easily understandable.

DETAILED DESCRIPTION OF THE PREFERRED EMBODIMENTS

Figure 1:
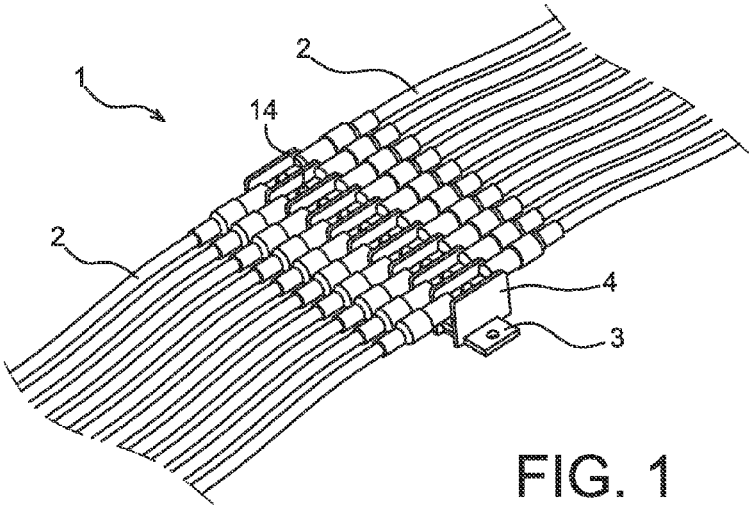
FIG. 1 shows a perspective view of an example of a power breaker strip with terminals according to the prior art for the connection of power cables.
Figure 2:
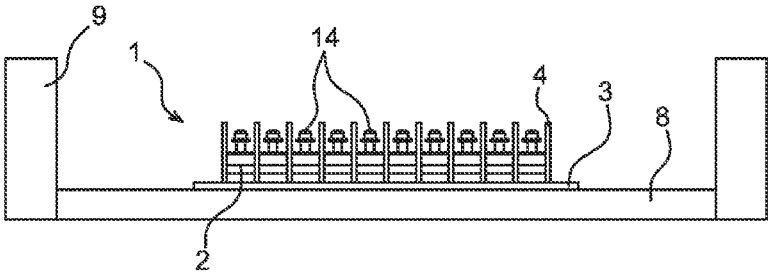
FIG. 2 shows a diagrammatic and partial view of the breaker strip in FIG. 1 placed in its environment onboard an aircraft.
Figure 3:
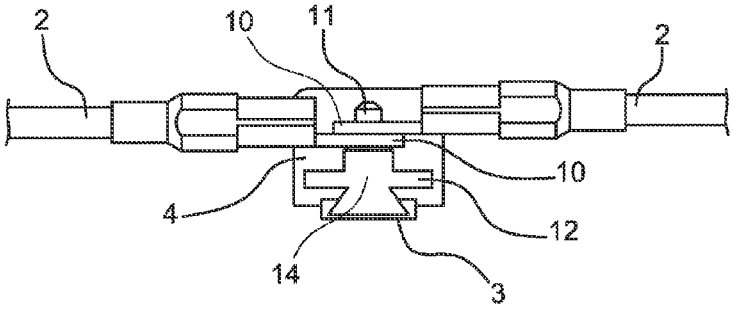
FIG. 3 shows a detailed embodiment of a power cable connection terminal of the breaker strip in FIG. 1.

The following describes one exemplary embodiment of the invention with reference to FIGS. 4 to 8. FIGS. 1 to 3 according to the prior art have already been described.

Figure 4:
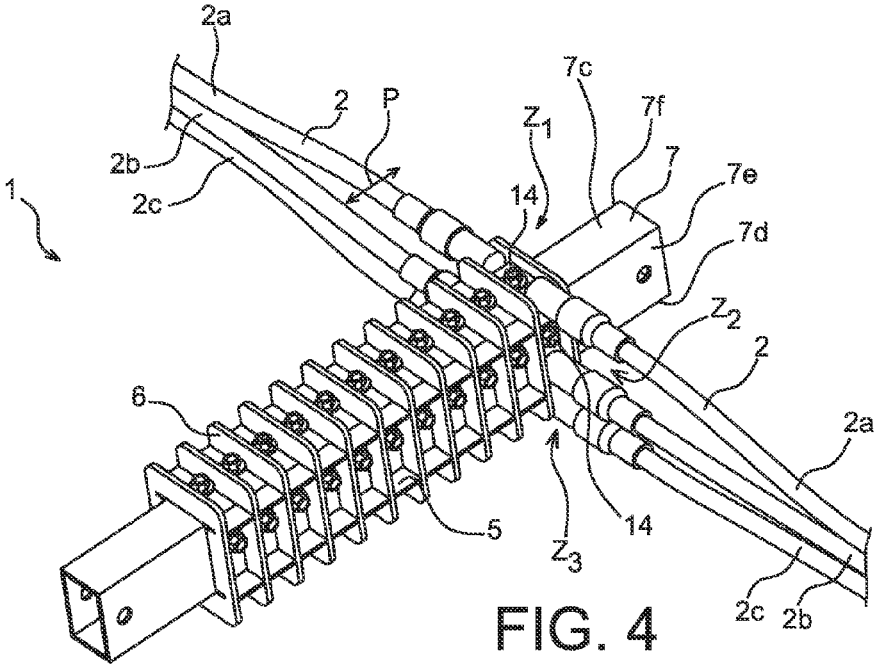
FIG. 4 shows a perspective view of a power breaker strip with terminals for the connection of power cables, illustrating one embodiment of the invention.

FIG. 4 shows a perspective view of an example of a power breaker strip 1 with terminals that shows one embodiment of the invention.

The breaker strip 1 comprises a strip support 7 and a plurality of electrically insulating interphase spacer elements 6, distributed along the strip support 7 with a space between two consecutive interphase spacer elements 6 that defines a pitch P of the breaker strip 1.

Furthermore according to the invention, the breaker strip 1 comprises a plurality of electrically insulating interline spacer elements 5, particularly four interline spacer elements 5, that are assembled with the plurality of interphase spacer elements 6 such that each interline spacer element 5 extends at least partly between two consecutive interphase spacer elements 6.

The interphase spacer elements 6 and the interline spacer elements 5 together delimit a plurality of zones Z1, Z2 and Z3 per pitch P of the breaker strip 1 so as to hold the connection terminals 14 for the connection of several lines 2*a*, 2*b* and 2*c* of power cables 2.

Figure 6:
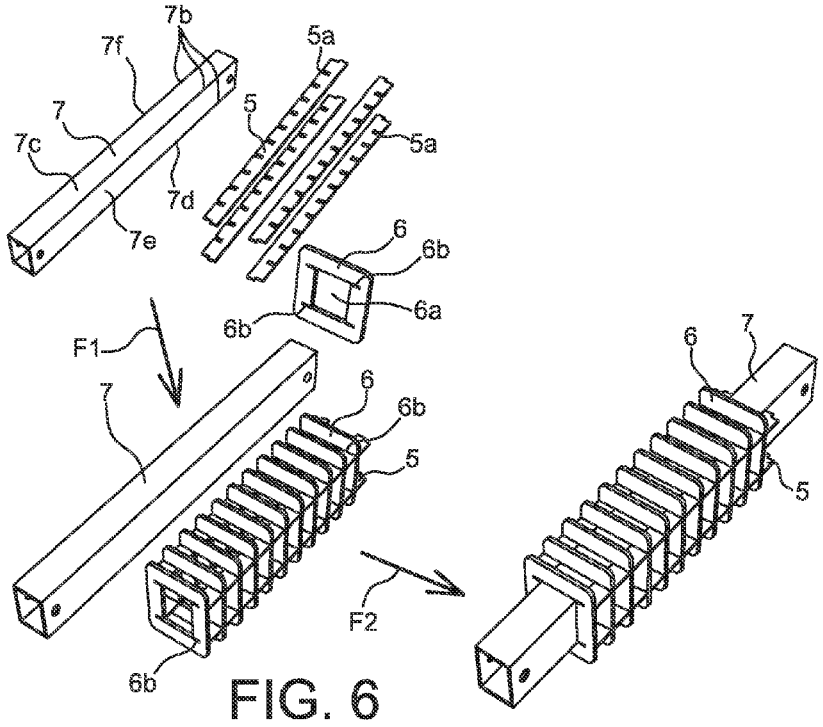
FIG. 6 shows steps in the method of assembling the breaker strip in FIG. 4.

As can be seen more easily in FIG. 6 that shows steps in the method of assembling the breaker strip 1 in FIG. 4, the strip support 7 is in the shape of a multifunctional tube with four external faces 7*c*, 7*d*, 7*e*, 7*f*, and particularly a top face 7*c* opposite a bottom face 7*d* and two opposite side faces 7*e* and 7*f*, these four faces being in contact with the interphase spacer elements 6.

For example, the strip support 7 may be made from an extruded tube made of a composite material. It may be cut to a required length depending on the environment in which the breaker strip 1 will be installed. The strip support 7 may also be in the shape of a hollow tube, its internal volume being made secure. For example, end plugs may be provided if necessary, or a mesh through which heat can be evacuated.

The interphase spacer elements 6 may be in the form of square-shaped plates with a central opening 6*a*, also square in shape. Advantageously, the square shape of the central opening 6*a* is designed for insertion of the strip support 7, also square in section, through the opening 6*a* of the interphase spacer elements 6 provided with interline spacer elements 5 as can be seen in FIG. 6. The interphase spacer elements 6 also comprise notches 6*b* formed around the periphery of the central opening 6*a*, particularly at the four corners of the square-shaped opening 6*a*.

The interline spacer elements 5 may be longitudinal in shape and approximately rectangular. They also comprise notches 5*a* formed around their periphery for the insertion of interphase spacer elements 6, as can be seen in FIG. 6. In particular, the notches 6*b* of the interphase spacer elements 6 are inserted in the notches 5*a* of the interline spacer elements 5.

Components of the breaker strip 1, and particularly interphase spacer elements 6 and/or interline spacer elements 5 and/or the strip support 7 may be made of a composite material so as to obtain a strong and lightweight breaker strip 1. The composite material may for example be a mix of glass fibres and resin.

A method with at least two steps may be used for assembly of the consecutive elements of the breaker strip 1, as shown in FIG. 6.

During a first step F1, the interphase spacer elements 6 may be assembled with the interline spacer elements 5 by the insertion of notches 6*b* of the interphase spacer elements 6 in the notches 5*a* of the interline spacer elements 5. This assembly may be made such that each of the four interline spacer elements 5 is located approximately at one of the four edges 7*b* of the strip support 7, such that each interphase spacer element 6 is assembled to the four interline spacer elements 5. In this way, the assembly thus formed by the assembly of the interline spacer elements 5 and the interphase spacer elements 6 can hold itself in position due to the geometries of these elements. Furthermore, this position can be secured by at least partial attachment of the interphase spacer elements 6 to the interline spacer elements 5, particularly by gluing.

Then in a step F2, the strip support 7 is inserted inside the assembly composed of the interphase spacer elements 6 and the interline spacer elements 5 through openings 6*a* in the interphase spacer elements 6. In this way, the strip support 7 performs twofold security for holding interphase spacer elements 6 and interline spacer elements 5 pre-assembled during step F1.

Figure 5:
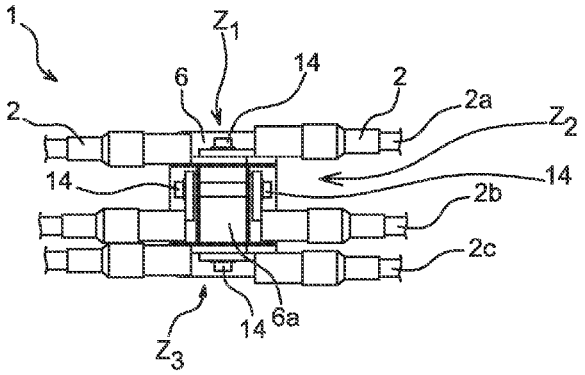
FIG. 5 shows a detailed embodiment of connection terminals for the breaker strip power cables in FIG. 4.

In this way, as can be seen in FIG. 4, and in FIG. 5 that shows a detail embodiment of the connection terminals 14 of the power cables 2, the interphase spacer elements 6 and the four interline spacer elements 5 together delimit the three zones Z1, Z2 and Z3 per pitch P of the breaker strip 1, to hold the connection terminals 14 of the three lines 2*a*, 2*b* and 2*c* of power cables 2.

More particularly, a first upper zone Z1 of the pitch P contains a connection terminal 14 of a first line 2*a* of power cables, the terminal 14 being fixed on the first face 7*c* of the strip support 7. A third lower zone Z3 of the pitch P also contains a connection terminal 14 of a third line 2*c* of power cables, the terminal 14 being fixed on the second face 7*d* of the strip support 7 opposite the first face 7*c*. Finally, a second intermediate zone Z2 of the pitch P contains two connection terminals 14 of the second line 2*b* of power cables, the two terminals 14 being fixed onto the third 7*e* and fourth 7*f* opposite faces of the strip support 7 respectively.

More precisely, in the first Z1 and third Z3 zones of the pitch P, the first 2*a* and the third 2*c* lines of power cables are connected flat by lugs bearing on the power cables 2, held in place by studs. On the other hand, in the second zone Z2 of pitch P, the power cables 2 of the second line 2*b* are held in place by welded lugs (see FIG. 5), on each side of the strip support 7, the transfer being obtained by shouldered studs.

Consequently, the breaker strip 1 is more compact because it enables the connection of more than three electrical cables 2 in a single pitch P. Thus for example, a three-phase line may be broken in a single pitch P. The breaker strip 1 is also easier to make, it is adaptive and the basic material used is lighter in weight, due to the use of composite material. It can also be used to make a relatively high power breaker assembly while simplifying the execution of this task.

Figure 7:
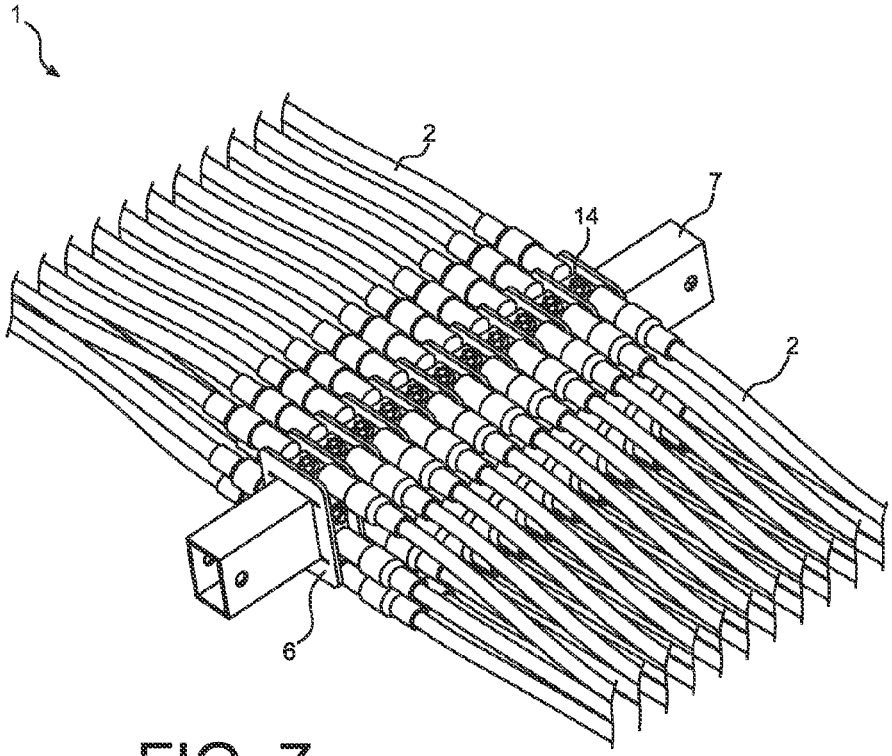
FIG. 7 shows a perspective view of the breaker strip in FIG. 4 in a configuration in which three power cable lines are electrically connected per pitch on the strip, and FIG. 8 very diagrammatically shows the space occupied by the breaker strip in FIG. 4 fitted with power cables in the environment of an aircraft.

Thus, as shown in FIG. 7, the space occupied by the breaker strip 1 and the power cables 2 may be three times smaller than is possible with the solution according to the prior art as shown in FIG. 1. The connection of the three lines 2*a*, 2*b*, 2*c* of power cables 2 per pitch P of the breaker strip 1 as shown in FIG. 7 would be equivalent to using three breaker strips like those shown in FIG. 1 in the solution according to the prior art.

Figure 8:
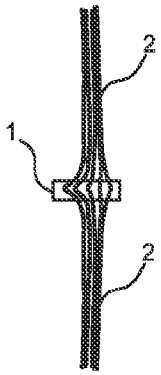

Furthermore, the triple density of the breaker strip 1 according to the invention can simplify routing during installation in the environment of the electrical installation, and particularly onboard an aircraft. As shown in FIG. 8, the triple density of the breaker strip 1 can give straight routing of power cables 2, unlike the routing that can be made with the solution according to the prior art in FIG. 1 that required a 90° bend of the power cables 2 to reach an area containing breaker strips and a return bend in the forward direction to return to the power cable line once the break has been made. On the other hand with this invention, a breaker assembly can be made with the breaker strip according to the invention along a straight line, thus saving space.

Obviously, the invention is not limited to the example embodiment that has just been disclosed. Those skilled in the art can make various modifications to it.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A power breaker strip comprising:

a strip support having an outer surface, a plurality of electrically insulating interphase spacer elements distributed along the strip support with a space between two consecutive interphase spacer elements defining a pitch of the power breaker strip, a plurality of electrically insulating interline spacer elements, assembled with the plurality of interphase spacer elements such that each interline spacer element extends at least partly between two consecutive interphase spacer elements, the interphase spacer elements and the interline spacer elements delimiting a plurality of pitch zones per pitch between them and positioned around the outer surface of the strip support, and a plurality of connection terminals spaced along the power breaker strip, each terminal is located on the outer surface of the strip support within a corresponding pitch zone wherein each at least one connection terminal is separated by one of the plurality of electrically insulating interphase spacer elements and one of the plurality of plurality of electrically insulating interline spacer elements.

2. The breaker strip according to claim 1, wherein each interphase spacer element comprises an opening through which the strip support can pass.

3. The breaker strip according to claim 1, wherein at least one of the interline spacer elements and the interphase spacer elements comprise notches into which at least one of interphase spacer elements and interline spacer elements can be inserted.

4. The breaker strip according to claim 1, wherein the strip support comprises at least four external faces in contact with the interphase spacer elements.

5. The breaker strip according to claim 4, further comprising at least four interline spacer elements, each interline spacer element being located approximately at an edge of the strip support.

6. The breaker strip according to claim 5, wherein each interphase spacer element is assembled to said at least four interline spacer elements.

7. The breaker strip according to claim 1, wherein the interphase spacer elements and the interline spacer elements delimit at least three zones per pitch between them in which the connection terminals of at least three lines of electrical cables can fit.

8. The breaker strip according to claim 4 wherein the interphase spacer elements and the interline spacer elements delimit at least three zones per pitch between them in which the connection terminals of at least three lines of electrical cables can fit, and wherein a first pitch zone contains a connection terminal of a first line of electrical cables fixed on a first face of the strip support, wherein a third pitch zone contains a connection terminal of a third line of electrical cables fixed on a second face of the strip support opposite the first face, and wherein a second pitch zone contains two connection terminals of a second line of electrical cables, fixed onto the third and fourth opposite faces respectively of the strip support.

9. The breaker strip according to claim 1, wherein at least one of the strip support, the plurality of interphase spacer elements, and the plurality of interline spacer elements are made of a composite material.

10. An electrical installation comprising a power breaker strip according to claim 1, to connect electrical cables to each other.

11. The electrical installation according to claim 10, wherein at least three lines of electrical cables are electrically connected per pitch of the power breaker strip.

12. A method for assembling a power breaker strip comprising a strip support having an outer surface, a plurality of interphase, electrically insulating spacer elements distributed along the strip support with a space between two consecutive interphase spacer elements defining a pitch of the power breaker strip, and a plurality of electrically insulating interline spacer elements, assembled with the plurality of interphase spacer elements such that each interline spacer element extends at least partly between two consecutive interphase spacer elements, the interphase spacer elements and the interline spacer elements delimiting a plurality of pitch zones per pitch between them in which connection terminals for several electrical cable lines, can be placed, each interphase spacer element comprising an opening through which the strip support can pass, the method comprising the following steps in sequence:

assembling interphase spacer elements with interline spacer elements, by the insertion of notches in the interphase spacer elements in notches in the interline spacer elements, attaching interphase spacer elements to interline spacer elements, and inserting the strip support inside the assembly composed of the assembly of interphase spacer elements and interline spacer elements through the openings in the interphase spacer elements wherein the pitch zones are located around the outer surface of the strip support.

13. A power breaker strip comprising:

a strip support, a plurality of electrically insulating interphase spacer elements distributed along the strip support with a space between two consecutive interphase spacer elements defining a pitch of the power breaker strip, and a plurality of electrically insulating interline spacer elements, assembled with the plurality of interphase spacer elements such that each interline spacer element extends at least partly between two consecutive interphase spacer elements, the interphase spacer elements and the interline spacer elements delimiting a plurality of pitch zones per pitch between them in which connection terminals for several electrical cable lines, can be placed, wherein the strip support comprises at least four external faces in contact with the interphase spacer elements, wherein the interphase spacer elements and the interline spacer elements delimit at least three zones per pitch between them in which the connection terminals of at least three lines of electrical cables can fit, and wherein a first pitch zone contains a connection terminal of a first line of electrical cables fixed on a first face of the strip support, wherein a third pitch zone contains a connection terminal of a third line of electrical cables fixed on a second face of the strip support opposite the first face, and wherein a second pitch zone contains two connection terminals of a second line of electrical cables, fixed onto the third and fourth opposite faces respectively of the strip support.

* * * * *